US006677008B2

(12) United States Patent
Chen et al.

(10) Patent No.: US 6,677,008 B2
(45) **Date of Patent: *Jan. 13, 2004**

(54) INK JET RECORDING ELEMENT

(75) Inventors: Tienteh Chen, Milpitas, CA (US); Lixin Chu, Rochester, NY (US); Sridhar Sadasivan, Rochester, NY (US); Elizabeth A. Gallo, Penfield, NY (US); Xiaoru Wang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/105,744

(22) Filed: Mar. 25, 2002

(65) Prior Publication Data

US 2002/0155260 A1 Oct. 24, 2002

Related U.S. Application Data

(63) Continuation-in-part of application No. 09/522,151, filed on Mar. 9, 2000, now abandoned.

(51) Int. Cl.[7] ..... B41M 5/00

(52) U.S. Cl. ..... 428/32.37; 428/32.38

(58) Field of Search ..... 428/195, 327, 428/32.6, 32.37, 32.38

(56) References Cited

U.S. PATENT DOCUMENTS

| | | | | | |
|---|---|---|---|---|---|
| 4,391,928 | A | * | 7/1983 | Herman et al. | 523/201 |
| 5,576,088 | A | | 11/1996 | Ogawa et al. | 428/327 |
| 5,912,071 | A | | 6/1999 | Takeshita et al. | 428/304.4 |
| 6,099,956 | A | | 8/2000 | Jones | 428/323 |
| 6,375,320 | B1 | * | 4/2002 | Chu et al. | 347/105 |

* cited by examiner

*Primary Examiner*—B. Hamilton Hess
(74) *Attorney, Agent, or Firm*—Harold E. Cole; Chris P. Konkol

(57) ABSTRACT

An ink jet recording element having a substrate having thereon an image-receiving layer of a filler and coated particles of a polymeric hard core-polymeric soft shell, the Tg of the polymeric hard core material being greater than about 60° C., the Tg of the polymeric soft shell material being less than about 100° C., and the filler being present in the image-receiving layer in an amount of from about 50 to about 95% by weight, the substrate being paper, resin-coated paper, synthetic paper, impregnated paper, cellulose acetate or a polyester film.

17 Claims, No Drawings

INK JET RECORDING ELEMENT

CROSS REFERENCE TO RELATED APPLICATION

This application is a continuation-in-part of U.S. patent application Ser. No. 09/522,151 by Chu et al., filed Mar. 9, 2000, abandoned.

FIELD OF THE INVENTION

This invention relates to an inkjet recording element. More particularly, this invention relates to an ink jet recording element containing coated particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. The challenge of making a porous image recording layer is to achieve a high gloss level without cracking, high color density, and a fast drying time.

U.S. Pat. No. 5,576,088 relates to an ink jet recording element wherein a gloss providing layer containing an inorganic filler and a latex is coated on top of an ink receiving layer. However, there is a problem with this element in that the drying time is slow and there is a tendency for the layer to exhibit cracks.

U.S. Pat. No. 5,912,071 relates to a recording medium comprising a substrate and a porous layer formed on the substrate wherein the porous layer comprises water insoluble resin particles preferably having a core/shell structure. However, there is no reference to the physical properties of the particles.

U.S. Pat. No. 6,099,956 relates to a recording medium comprising a support with a receptive layer coated thereon. The receptive layer comprises a water insoluble polymer that is preferably a copolymer comprising a styrene core with an acrylic ester shell. However, there is no reference to the physical properties of the particles.

It is an object of this invention to provide an ink jet recording element that has a fast ink dry time. It is another object of this invention to provide an ink jet recording element that has good image quality.

SUMMARY OF THE INVENTION

These and other objects are achieved in accordance with the invention which comprises an inkjet recording element comprising a substrate having thereon an image-receiving layer comprising a filler and coated particles comprising a polymeric hard core-polymeric soft shell, the Tg of the polymeric hard core material being greater than about 60° C., the Tg of the polymeric soft shell material being less than about 100° C., and the filler being present in the image-receiving layer in an amount of from about 50 to about 95% by weight, the substrate being paper, resin-coated paper, synthetic paper, impregnated paper, cellulose acetate or a polyester film.

The ink jet recording element of the invention provides a fast ink dry time and good image quality.

DETAILED DESCRIPTION OF THE INVENTION

As noted above, the substrate used in the invention may be porous such as paper or non-porous such as resin-coated paper; synthetic paper, such as Teslin® or Tyvek®; an impregnated paper such as Duraform®; cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinyl acetate copolymer, can be applied to the surface of the support. The papers listed above include a broad range of papers, from high end papers, such as photographic paper to low end papers, such as newsprint. In a preferred embodiment, Ektacolor paper made by Eastman Kodak Co. is employed.

The support used in the invention may have a thickness of from about 50 to about 500 μm, preferably from about 75 to 300 μm. Antioxidants, antistatic agents, plasticizers and other known additives may be incorporated into the support, if desired.

As described above, the image-receiving layer of the invention contains a filler. Any filler may be used in the invention, such as a metal oxide, metal hydroxide, calcium carbonate, barium sulfate, clay or organic particles such as polymeric beads. Examples of organic particles useful in the invention are disclosed and claimed in U.S. patent application Ser. Nos. 09/458,401, filed Dec. 10, 1999; 09/608,969, filed Jun. 30, 2000; 09/607,417, filed Jun. 30, 2000; 09/608,466 filed Jun. 30, 2000; 09/607,419, filed Jun. 30, 2000; and 09/822,731, filed Mar. 30, 2001; the disclosures of which are hereby incorporated by reference. In a preferred embodiment of the invention, the metal oxide is silica, alumina, zirconia or titania. In another preferred embodiment of the invention, the particle size of the filler is from about 5 nm to about 5000 nm. In still another preferred embodiment of the invention, the filler is present in an amount of from about 50 to about 95% by weight of materials present in the image-receiving layer.

In a preferred embodiment of the invention, the coated particles comprising a polymeric hard core-polymeric soft shell comprises polymeric particles having a core of material having a relatively high Tg which is coated with another polymer having a lower Tg. The coated particles used in the invention may be prepared by emulsion polymerization as described in "Emulsion Polymerization and Emulsion Polymers", edited by P. A. Lovell and M. S. El-Aassar, John Wiley and Sons, 1997. For example, the coated particles is by adsorption of prepared by polymerizing a monomer in the presence of the polymeric hard core material. Another technique for preparing the coated particles is by adsorption of the polymeric soft shell material onto the surface of the polymeric hard core material. Still another technique for preparing the coated particles is by forming chemical bonds between the polymeric hard core material and the polymeric soft shell material.

Any polymeric material may be used as the polymeric hard core of the coated particles of the invention, such as poly(methylmethacrylate), poly(styrene), poly(p-methylstyrene), poly(t-butylacrylamide), poly(styrene-co-methylmethacrylate), poly(styrene-co-t-butylacrylamide), poly(methylmethacrylate-co-t-butylacrylamide), and homopolymers derived from p-cyanophenyl methacrylate, pentachlorophenyl acrylate, methacrylonitrile, isobomyl methacrylate, phenyl methacrylate, acrylonitrile, isobomyl acrylate, p-cyanophenyl acrylate, 2-chloroethyl acrylate, 2-chloroethyl methacrylate, 2-naphthyl acrylate, n-isopropyl acrylamide, 1-fluoromethyl methacrylate, isopropyl methacrylate, and 2-hydroxypropyl methacrylate. In a preferred embodiment of the invention, the polymeric material comprises particles of poly(methyl-methacrylate), polystyrene, poly(p-methylstyrene), poly(t-butylacrylamide) or poly(styrene-co-methyhnethacrylate). In another preferred embodiment of the invention, the particle size of the polymeric particles is from about 5 nm to about 1000 nm. In yet another preferred embodiment of the invention, the Tg of the polymeric particle is at least about 60° C., preferably from about 60° C. to about 150° C.

The polymeric soft shell material employed in the invention has a Tg of less than about 100° C., preferably from about −50° C. to about 65° C. Methods for determining Tg values of organic polymers are described in "Introduction to Physical Polymer Science", 2nd Edition by L. H. Sperling, published by John Wiley & Sons, Inc., 1992. For each of the organic polymers in Table 1 below, the Tg value was calculated as the weighted sum of the Tg values for homopolymers derived from each of the individual monomers, i, that make up the polymer:

$$Tg = \sum_i W_i X_i$$

where W is the weight percent of monomer i in the organic polymer, and X is the Tg value for the homopolymer derived from monomer i. Tg values for the homopolymers were taken from "Polymer Handbook", 2nd Edition by J. Brandrup and E. H. Immergut, Editors, published by John Wiley & Sons, Inc., 1975.

In a preferred embodiment of the invention, monomers used to prepare the polymeric soft shell material include acrylate and styrene monomers which may have a cationic, anionic, or nonionic functionality such as quaternary ammonium, pyridinium, imidazolium, sulfonate, carboxylate or phosphonate groups. Examples of useful monomers include: n-butyl acrylate, n-ethylacrylate, 2-ethylhexylacrylate, methoxyethylacrylate, methoxyethoxy-ethylacrylate, ethoxyethylacrylate, ethoxyethoxyethylacrylate, 2-ethylhexyl methacrylate, n-propylacrylate, hydroxyethylacrylate, etc. and cationic monomers such as a salt of trimethylammoniumethyl acrylate and trimethylammoniumethyl methacrylate, a salt of triethylammoniumethyl acrylate and triethylammoniumethyl methacrylate, a salt of dimethylbenzylammoniumethyl acrylate and dimethylbenzylammoniumethyl methacrylate, a salt of dimethylbutylammoniumethyl acrylate and dimethylbutylammoniumethyl methacrylate, a salt of dimethylhexylammoniumethyl acrylate and dimethylhexylammoniumethyl methacrylate, a salt of dimethyloctylammoniumethyl acrylate and dimethyloctylammoniumethyl methacrylate, a salt of dimethyldodeceylammoniumethyl acrylate and dimethyldocecylammoniumethyl methacrylate, a salt of dimethyloctadecylammoniumethyl acrylate and dimethyloctadecylammoniumethyl methacrylate, etc. Salts of these cationic monomers that can be used include chloride, bromide, methylsulfate, triflate, etc.

Examples of these polymeric soft shell materials include poly(n-butylacrylate-co-vinylbenzyltriimethylammonium chloride), poly(n-butylacrylateco-vinylbenzyltrimethylammonium bromide), poly(n-butylacrylate-co-vinylbenzyldimethylbenzylammonium chloride) and poly(n-butylacrylate-co-vinylbenzyldimethyloctadecylammonium chloride). In a preferred embodiment of the invention, the polymeric soft shell material can be poly(n-butyl acrylate), poly(2-ethylhexyl aclylate) poly(methoxyethylacrylate), poly (ethoxyethylacrylate), poly(n-butylacrylate-co-trimethylarnmoniumethyl acrylate), poly(n-butylacrylate-co-trimethylammoniumethyl methacrylate) or poly(n-butylacrylate-co-vinylbenzyltrimethylammonium chloride).

Any weight ratio of the polymeric hard core material to the polymeric soft shell material can be used. Preferably, the weight ratio of the polymeric hard core material to the polymeric soft shell material is from about 0.2:1 to about 20:1.

Following are examples of coated particles of polymeric soft shell-polymeric hard core materials that can be used in the invention:

TABLE 1

| Coated Particles | Core Material (wt. %) | Shell Material (wt. %) | Tg of Shell Material (° C.) |
|---|---|---|---|
| 1 | Polystyrene (50) | Poly n-butylacrylate (50) | −54 |
| 2 | Polystyrene (50) | Poly n-ethyl-hexylacrylate (50) | −50 |
| 3 | Polymethyl-methacrylate (50) | Poly n-butylacrylate (50) | −54 |
| 4 | Polystyrene (40) | Poly n-butyl-acrylate (60) | −54 |
| 5 | Polymethyl-methacrylate (40) | Poly n-butyl-acrylate (60) | −54 |
| 6 | Polystyrene (40) | Poly(n-butylacrylate-co-trimethylammonium ethyl methacrylate(40:20) | −29 |
| 7 | Polymethyl-methacrylate (40) | Poly(n-butylacrylate-co-trimethylammonium ethyl methacrylate(40:20) | −29 |
| 8 | Polystyrene (40) | Poly(n-butylacrylate-co-vinylbenzyltrimethyl-ammonium chloride) (40:20) | −2 |
| 9 | Polymethyl-methacrylate (40) | Poly(n-butylacrylate-co-vinylbenzyltrimethyl-ammonium chloride) (40:20) | −2 |
| 10 | Polystyrene (40) | Poly n-ethylhexylacrylate (60) | −50 |
| 11 | Poly(styrene) (50) | Poly(n-butyl methacrylate-co-ethyl methacrylate) (25:25) | 40 |
| 12 | Poly(styrene) (50) | Poly(ethyl methacrylate) (50) | 60 |
| 13 | Poly(styrene) (50) | Poly(ethyl methacrylate-co-methyl methacrylate) (25:25) | 82 |
| 14 | Poly(styrene) (50) | Poly(n-butylacrylate-co-trimethylammonium-ethyl methacrylate methylsulfate) (25:25) | 12 |
| 15 | Poly(methyl methacrylate) (88) | Poly(n-butylacrylate-co-trimethylammonium-ethyl methacrylate methylsulfate) (8:4) | 1 |
| 16 | Poly(methyl methacrylate) (33) | Poly(ethyl methacrylate-co-trimethylammonium-ethyl methacrylate methylsulfate) (44:23) | 58 |

In a preferred embodiment of the invention, the coated particles comprise up to about 50 wt. % of the image-receiving layer.

The image-receiving layer of the invention may also contain a polymeric binder in an amount insufficient to alter its porosity. In a preferred embodiment, the polymeric binder is a hydrophilic polymer, such as poly(vinyl alcohol), poly(vinyl pyrrolidone), gelatin, cellulose ethers, poly (oxazolines), poly(vinylacetamides), partially hydrolyzed poly(vinyl acetate/vinyl alcohol), poly(acrylic acid), poly (acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like; or a low Tg latex such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc. The polymeric binder should be chosen so that it is compatible with the aforementioned particles.

The amount of binder used should be sufficient to impart cohesive strength to the ink jet recording element, but should also be minimized so that the interconnected pore structure formed by the aggregates is not filled in by the binder. In a preferred embodiment of the invention, the weight ratio of the binder to the total amount of particles is from about 1:20 to about 1:5.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

An ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 $\mu$m, preferably from about 5 to about 40 $\mu$m.

In addition to the image-receiving layer, the recording element may also contain a base layer, next to the support, the function of which is to absorb the solvent from the ink. Materials useful for this layer include inorganic particles and polymeric binder.

In addition to the image-receiving layer, the recording element may also contain a layer on top of the image-receiving layer, the function of which is to provide gloss. Materials useful for this layer include sub-micron inorganic particles and/or polymeric binder.

After coating, the ink jet recording element may be subject to calendering or supercalendering to enhance surface smoothness. In a preferred embodiment of the invention, the inkjet recording element is subject to hot, soft-nip calendering at a temperature of about 65° C. and a pressure of 14000 kg/m at a speed of from about 0.15 m/s to about 0.3 m/s.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention.

EXAMPLES

Example 1

Synthesis of coated particles 1

Coated particles of this invention were prepared by a sequential emulsion polymerization technique. In general, the polymeric hard core material is polymerized first followed by the sequential feeding of the monomer emulsions used to prepare the polymeric soft shell material. A typical synthetic procedure of the coated particles used in this invention is described below. The following ingredients were used:

TABLE 2

| Ingredient (g) |
|---|
| A: Deionized Water (200) |
| CTAB* (2) |
| B: 2,2'-Azobis(2-methylpropionamidine) HCL salt (0.5) |
| C: Styrene (200) |
| 2,2'-Azobis(2-methylpropionamidine) HCL salt (2) |
| CTAB (20) |
| Deionized Water (200) |
| D Butyl Acrylate (200) |
| 2,2'-Azobis(2-methylpropionamidine) HCL salt (2) |
| CTAB (20) |
| Deionized Water (200) |

CTAB* is Cetyltrimethylammonium Bromide.

Procedure 1. (A) was charged to a 2 L 3-neck flask equipped with a nitrogen inlet, mechanical stirrer and condenser. The flask was immersed in a constant temperature bath at 80° C. and purged with nitrogen for 20 min.
2. (B) was added and followed by the addition of monomer emulsion (C). The mixture was agitated all the time during the feeding of monomer emulsion. The monomer emulsion was withdrawn from the bottom of the monomer reservoir with a Fluid Metering Pump. The addition time of monomer emulsion (C) was one hour and twenty minutes.
3. The polymerization was continued for 30 min after the addition of the first monomer.
4. The second monomer emulsion (D) was prepared in the same way. The total addition time was one hour and twenty minutes.
5. The latex was heated at 80° C. for one hour and cooled to 60° C.
6. 4 ml of 10% t-butyl hydroperoxide and 10% formaldehyde-sulfite were added to remove the residual monomer and held for 30 minutes.
7. The mixture was cooled to RT and filtered.
8. The final % solid was 40.7% and the particle size was 81.2 nm.

Example 2

Element Preparation

Element 1 of the Invention

A paper base of Nekoosa Solutions Smooth® (Georgia Pacific Co.), Grade 5128 (Carrara White®, Color 9220), basis weight 150 g/m$^2$, was coated with an suspension comprising 70 wt. % colloidal silica (Naycol® IJ 222, Akzo Nobel Co.) and 30 wt. % Coated Particles 1 described above. The coating solution was 20 wt. % total solids. The coating was applied onto the paper base using a wire wound Meyer rod of wire diameter 0.51 $\mu$m with a wet laydown thickness of 10 $\mu$m. The element was oven dried at 60° C.

Element 2 of the Invention

This element was prepared the same as Element 1 except that only 20 wt. % of Coated Particles 1 were used along with 10 wt. % of a polyurethane latex (Witcobond® W-213, Witco Corp.)

Element 3 of the Invention

This element was prepared the same as Element 1 except that the colloidal silica was replaced with colloidal boehmite (Dispal® 14N4-25, Condea Vista Co.).

Element 4 of the Invention

This element was prepared the same as Element 2 except that the colloidal silica was replaced with colloidal boehmite (Dispal® 14N4-25, Condea Vista Co.).

Element 5 of the Invention

A synthetic paper base (Teslin®, 250 $\mu$m, PPG Industry) was coated with an suspension comprising 80 wt. % colloidal silica (Naycol® IJ 222 Akzo Nobel Co.) and 20 wt. % Coated Particles 1. The coating solution was 20 wt. % total solids. The coating was applied onto the synthetic paper base using a wire wound Meyer rod of wire diameter 0.51 $\mu$m with a wet laydown thickness of 10 $\mu$m. The element was air dried at ambient conditions.

Element 6 of the Invention

This element was prepared the same as Element 5 except that only 15 wt. % of Coated Particles 1 were used along with 5 wt. % of a polyacrylic latex (Rhoplex® P-308, Rohm and Haas Co.).

Element 7 of the Invention

This element was prepared the same as Element 5 except that Coated Particles 2 were used instead of Coated Particles 1.

Element 8 of the Invention

This element was prepared the same as Element 5 except that Coated Particles 3 were used instead of Coated Particles 1.

Comparative Element 1

This element was prepared the same as Element 1 except that a polyurethane latex (Witcobond® W-213, Witco Corp.) was used instead of Coated Particles 1.

Comparative Element 2

This element was prepared the same as Element 1 except that a non-core/shell polymer, poly(styrene-co-butyl acrylate) was used instead of Coated Particles 1.

Comparative Element 3

This element was prepared the same as Comparative Element 1 except that the colloidal silica was replaced with colloidal boehmite (Dispal® 14N4-25, Condea Vista Co.).

Comparative Element 4

This element was prepared the same as Comparative Element 3 except that a non-core/shell polymer, poly (styrene-co-butyl acrylate) was used instead of the polyurethane latex.

Comparative Element 5

This element was prepared the same as Element 5 of the invention except that the Naycol® IJ 222 colloidal silica was replaced with Naycol® IJ 100 colloidal silica (Akzo Nobel Co.) and Coated Particles 1 were replaced with 20 wt. % of a polyacrylic latex (Rhoplex® P-308, Rohm and Haas Corp.).

Comparative Element 6

This element was prepared the same as Comparative Element 5 except that a non-core/shell polymer, poly (styrene-co-butyl acrylate) was used instead of a polyacrylic latex.

Printing

Images were printed using either an Epson Stylus Color 740 printer for dye-based inks using Color Ink Cartridge S020191/IC3CL01; or an Novajet III® wide-format inkjet printer for pigment-based inks using Kodak Professional Pigmented Inks: Black, Magenta, Cyan and Yellow. The images comprised a series of cyan, magenta, yellow, black, green, red and blue strips, each strip being in the form of a rectangle 0.8 cm in width and 20 cm in length.

Dry Time

Immediately after ejection from the printer, a piece of bond paper was placed over the printed image and rolled with a smooth, heavy weight. Then the bond paper was separated from the printed image. The length of dye transfer on the bond paper was measured to estimate the time needed for the printed image to dry. The dry time is rated as 1 when there is no transfer of the inks to the bond paper. If there is a full transfer of at least one color strip, the dry time is rated as 5. Intermediate transfer lengths are rated in-between 1 and 5.

Image Quality

The image quality was evaluated subjectively. Coalescence refers to the non-uniformity or puddling of the ink in solid filled areas. Bleeding refers to the inks flowing out of its intended boundaries.

The following results were obtained:

TABLE 3

| Epson 740 Printer | | |
|---|---|---|
| Element | Dry Time | Image Quality |
| 1 | 1 | Good |
| 2 | 2 | Good |
| 3 | 2 | Good |
| 4 | 2 | Good |
| Comparative 1 | 3 | Slight coalescence |
| Comparative 2 | 5 | Slight coalescence, slight bleeding |
| Comparative 3 | 5 | Severe coalescence and bleeding |
| Comparative 4 | 5 | Severe coalescence and bleeding |

TABLE 4

| Novajet III Printer | | |
|---|---|---|
| Element | Dry Time | Image Quality |
| 5 | 1 | Good |
| 6 | 1 | Good |
| 7 | 1 | Good |
| 8 | 1 | Good |
| Comparative 5 | 2 | severe coalescence |
| Comparative 6 | 2 | severe coalescence |

The above results show that the elements of the invention had good dry time and image quality as compared to the control elements that had poorer dry times and poorer image quality.

Example 3

Synthesis of Coated Particles 11

200 g of deionized water and 2 g of cetyltrimethylammonium bromide (CTAB) were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of 2,2'-azobis(2-methylpropionamidine) hydrochloride (AMA) was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 100 g of n-butyl methacrylate, 100 g of ethyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 40 wt. % solids and the particle size was 68 nm.

Synthesis of Coated Particles 12

200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 200 g of ethyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 41 wt. % solids and the particle size was 72 nm.

Synthesis of Coated Particles 13

200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 100 g of ethyl methacrylate, 100 g of methyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 39 wt. % solids and the particle size was 70 nm.

Element 9 of the Invention

A coating solution for a base layer was prepared by mixing 254 dry g of precipitated calcium carbonate Albagloss-s® (Specialty Minerals inc.) as a 70% solution, 22 dry g of silica gel Gasil® 23F (Crosfield Ltd.), 2.6 dry g of poly(vinyl alcohol) Airvol® 125 (Air Products) as a 10% solution, 21 dry g of styrene-butadiene latex CP692NA® (Dow Chemical Co.) as a 50% solution and 0.8 g of Alcogum® L-229 (Alco Chemical Co.). The solids of the coating solution was adjusted to 35 wt. % by adding water. The base layer coating solution was bead-coated at 25° C. on Ektacolor Edge Paper (Eastman Kodak Co.) and dried by forced air at 60° C. The thickness of the base layer was 25 $\mu$m or 27 g/m$^2$.

A coating solution for the image receiving layer was prepared by mixing 15.0 dry g of silica gel Nalco® 2329 (Nalco Co.) as a 40 wt. % solution, 6.3 dry g of Coated Particles 11 as a 40 wt. % solution and water to total 125 g.

The image-receiving layer coating solution was bead-coated at 25° C. on top of the base layer described above. The recording element was then dried by forced air at 104° C. for 5 minutes. The thickness of the image-receiving layer was 8 $\mu$m or 8.6 g/m$^2$.

Element 10 of the Invention

This element was prepared the same as Element 9 except that 6.3 dry g of Coated Particles 12 as a 41 wt. % solution was used instead of Coated Particles 11.

Element 11 of the Invention

This element was prepared the same as Element 9 except that 6.4 dry g of Coated Particles 3 as a 39 wt. % solution was used instead of Coated Particles 11.

Synthesis of Comparative Coated Particles 1 (Tg>100° C.)

200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 200 g of methyl methacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 40 wt. % solids and the particle size was 70 nm. The Tg of these particles is about 105° C.

Synthesis of Comparative Coated Particles 2 (Tg>100° C.)

200 g of deionized water and 2 g of CTAB were mixed in a 2 L 3-neck round bottom flask equipped with a mechanical stirrer, condenser and nitrogen inlet. The flask was immersed in a constant temperature bath at 80° C. and purged with nitrogen for 20 min. 0.5 g of AMA was then added.

A monomer emulsion comprising 200 g of styrene, 2 g of AMA, 20 g of CTAB and 200 g of deionized water was added over one hour with constant agitation. The reaction mixture was stirred for an additional 30 minutes. A second monomer emulsion comprising 190 g of methyl methacrylate, 10 g of ethylene glycol dimethacrylate, 2 g of AMA, 20 g of CTAB and 200 g of deionized water was added over one hour. The reaction mixture was stirred for an additional hour and then cooled to 60° C. 4 mL of 10 wt. % t-butyl hydroperoxide and 10 wt. % formaldehyde-sulfite were added and the resulting reaction mixture stirred for 30 minutes at 60° C. The reaction mixture was then cooled to room temperature and filtered. The resulting dispersion was 40 wt. % solids and the particle size was 76 nm.

The Tg of these particles is about 110° C. This value is obtained by adding 5° C. to the Tg value of the homopolymer derived from methyl methacrylate in order to account for the presence of the small amount of ethyleneglycol dimethacrylate.

Comparative Element 7

This element was prepared the same as Element 9 except that 6.3 dry g of Comparative Coated Particles 1 as a 40 wt. % solution was used instead of Coated Particles 11.

Comparative Element 8

This element was prepared the same as Element 9 except that 6.3 dry g of Comparative Coated Particles 2 as a 40 wt. % solution was used instead of Coated Particles 11.

Comparative Element 9

This element was prepared the same as Element 9 except that 0.9 dry g of poly(vinyl alcohol) Gohsenol® GH-17 (Nippon Gohsei Co. Ltd.) as a 10 wt. % solution was used instead of Coated Particles 11.

Coating Quality

The above dried coatings for visually evaluated for cracking defects. Results are tabulated in Table 5 below.

Image Quality & Dry Time

An Epson Stylus Color 740 printer for dye-based inks using Color Ink Cartridge S020191/IC3CL01 was used to print on the recording elements. The image consisted of adjacent patches of cyan, magenta, yellow, black, green, red and blue patches, each patch being in the form of a rectangle 0.4 cm in width and 1.0 cm in length. Bleed between adjacent color patches was qualitatively assessed. A second image was printed, and immediately after ejection from the printer, the image was wiped with a soft cloth. The dry time was rated as 1 if no ink and was smudged on the image. The dry time was rated as 2 if some ink smudged, and 3 if a lot of ink smudged. The following results were obtained:

TABLE 5

| Element | Coating Quality | Image Quality | Dry Time |
|---|---|---|---|
| 9 | No cracking | Little bleeding | 1 |
| 10 | No cracking | Little bleeding | 1 |
| 11 | No cracking | Little bleeding | 1 |
| Comparative 7 | Cracking | Bleeding | 2 |
| Comparative 8 | Cracking | Severe Bleeding | 2 |
| Comparative 9 | No cracking | Considerable bleeding | 3 |

The above results show that the recording elements of the invention have good coating quality, image quality and instant dry time as compared to the comparative recording elements.

This invention has been described with particular reference to preferred embodiments thereof but it will be understood that modifications can be made within the spirit and scope of the invention.

What is claimed is:

1. An ink jet recording element comprising a substrate having thereon a porous image-receiving layer comprising a filler and coated particles comprising a polymeric hard core-polymeric soft shell, said polymeric hard core material having a relatively higher Tg that is greater than 60° C., said polymeric soft shell material having a relatively lower Tg that is less than 100° C., and said filler being present in said image-receiving layer in an amount of from about 50 to about 95% by weight, said substrate being paper, resin-coated paper, synthetic paper, impregnated paper, cellulose acetate or a polyester film.

2. The recording element of claim 1 wherein said filler comprises a metal oxide, metal hydroxide, calcium carbonate, barium sulfate, clay or polymeric beads.

3. The recording element of claim 2 wherein said metal oxide is silica, alumina, zirconia or titania.

4. The recording element of claim 1 wherein the particle size of said filler is from about 5 nm to about 5000 nm.

5. The recording element of claim 1 wherein the particle size of said coated particles is from about 5 nm to about 1000 nm.

6. The recording element of claim 1 wherein said Tg of said polymeric soft shell material is from about −50° C. to about 65° C.

7. The recording element of claim 1 wherein said polymeric soft shell material is derived from a cationic, anionic or nonionic monomer.

8. The recording element of claim 7 wherein said monomer contains a quaternary ammonium, pyridinium, imidazolium, sulfonate, carboxylate or phosphonate functionality.

9. The recording element of claim 1 wherein said polymeric soft shell material is derived from an acrylate-containing monomer.

10. The recording element of claim 1 wherein said polymeric soft shell material is derived from a styrene-containing monomer.

11. The recording element of claim 9 wherein said polymeric soft shell material is poly(n-butyl acrylate), poly(2-ethylhexyl acrylate) poly(methoxyethylacrylate), poly (ethoxy-ethylacrylate), poly(n-butylacrylate-co-trimethylammoniumethyl acrylate), poly(n-butylacrylate-co-trimethylammoniumethyl methacrylate) or poly(n-butylacrylate-co-vinylbenzyltrimethylammonium chloride).

12. The recording element of claim 1 wherein said coated particles are prepared by polymerizing a monomer in the presence of said polymeric hard core material.

13. The recording element of claim 1 wherein said coated particles are prepared by adsorption of said polymeric soft shell material onto the surface of said polymeric hard core material.

14. The recording element of claim 1 wherein said coated particles are prepared by chemical bond formation between said polymeric hard cure material and said polymeric soft shell material.

15. The recording element of claim 1 wherein the weight ratio of said polymeric hard core material to said polymeric soft shell material is from about 0.2:1 to about 20:1.

16. The recording element of claim 1 wherein said polymeric hard core material is poly(methylmethacrylate), poly (styrene), poly(p-methylstyrene), poly(t-butylacrylamide) or poly(styrene-co-methylmethacrylate).

17. The recording element of claim 1 wherein a base layer is coated between said substrate and said image-receiving layer.

* * * * *